US011852451B2

(12) United States Patent
Huang et al.

(10) Patent No.: US 11,852,451 B2
(45) Date of Patent: Dec. 26, 2023

(54) PROTECTION EQUIPMENT, SYSTEM AND METHOD FOR DESTRUCTION OF EXPLOSIVES

(71) Applicant: BEIJING INSTITUTE OF TECHNOLOGY, Beijing (CN)

(72) Inventors: Guangyan Huang, Beijing (CN); Xiaobing Bian, Beijing (CN); Li Liu, Beijing (CN); Fenglei Huang, Beijing (CN); Qingbo Guo, Beijing (CN); Wei Li, Beijing (CN)

(73) Assignee: BEIJING INSTITUTE OF TECHNOLOGY, Beijing (CN)

( * ) Notice: Subject to any disclaimer, the term of this patent is extended or adjusted under 35 U.S.C. 154(b) by 0 days.

(21) Appl. No.: 18/081,657

(22) Filed: Dec. 14, 2022

(65) Prior Publication Data

US 2023/0184525 A1 Jun. 15, 2023

Related U.S. Application Data

(63) Continuation of application No. PCT/CN2021/098577, filed on Jun. 7, 2021.

(30) Foreign Application Priority Data

Jun. 15, 2020 (CN) ..... 202010542133.7

(51) Int. Cl.
*F42D 5/045* (2006.01)
*F42B 33/06* (2006.01)

(52) U.S. Cl.
CPC ..... *F42B 33/062* (2013.01)

(58) Field of Classification Search
CPC ..... F42D 5/04; F42D 5/045; F42B 33/062
See application file for complete search history.

(56) References Cited

U.S. PATENT DOCUMENTS 3,721,201 A * 3/1973 Boller ..... F42D 5/045 89/36.01
4,432,285 A * 2/1984 Boyars ..... B65F 1/1615 109/1 R
6,595,247 B1 * 7/2003 Landy ..... F42B 39/14 454/56
6,813,986 B1 * 11/2004 Tafoya ..... F42D 5/045 86/50

(Continued)

*Primary Examiner* — Derrick R Morgan
(74) *Attorney, Agent, or Firm* — Yong Chen

(57) ABSTRACT

Disclosed are a protection equipment, system and method for the destruction of explosives. The protection equipment for the destruction of explosives includes four modules: an inner fence, an outer fence, an anti-leakage fence and a top cover. The modular equipment takes an overall nonmetal flexible composite structure, and the individual modules are light in weight and convenient to operate. It can be operated by two persons or a single person. A protective effect can be achieved during destruction of explosives by using the protection equipment, and even if the explosives explode during destruction, it will not cause injury to surrounding personnel. A protection system for explosive destruction based on the protection equipment can be used to destroy unexploded bomb or explosives under protective conditions, thereby achieving rapid emergency disposal without making contact with the explosives.

9 Claims, 4 Drawing Sheets

(56) References Cited

U.S. PATENT DOCUMENTS

| | | | | |
|---|---|---|---|---|
| 7,490,537 | B1 * | 2/2009 | Vande Brake | F42D 5/045 86/50 |
| 8,413,564 | B1 * | 4/2013 | Genovese | F42D 5/045 102/303 |
| 11,506,465 | B1 * | 11/2022 | Foltz | F42D 1/043 |
| 11,536,549 | B1 * | 12/2022 | Kim | F42D 5/04 |
| 2005/0115384 | A1 * | 6/2005 | Reynolds | B65F 1/1607 86/50 |
| 2012/0304882 | A1 * | 12/2012 | Baum | F42D 5/04 102/301 |
| 2014/0323792 | A1 * | 10/2014 | Morris | C06B 21/0091 588/403 |
| 2019/0323809 | A1 * | 10/2019 | Keller | B65B 63/08 |
| 2020/0158478 | A1 * | 5/2020 | Green | F41J 9/165 |

* cited by examiner

PROTECTION EQUIPMENT, SYSTEM AND METHOD FOR DESTRUCTION OF EXPLOSIVES

FIELD

The present disclosure relates to protective equipment, and particularly relates to protective equipment for the destruction of explosives.

BACKGROUND

Effective protective equipment is in shortage when waste military unexploded ammunitions and civilian explosives are disposed. Traditional explosion-proof equipment used for protection is based on the use of high-strength metal structures. Due to the high density of the metal structure and high overall mass of the structure, the equipment is very inconvenient to carry. In addition, since waste ammunition is generally located in a soft ground such as a sandy land, an explosion-proof vehicle cannot be driven to the corresponding positions for disposal. During disposal of the waste unexploded ammunition, it is necessary to grab the ammunition with a corresponding grabbing tool and place the ammunition in an explosion-proof tank or explosion-proof vehicle. However, since the type of the ammunition is not clear, this grabbing method has a high risk of triggering a fuse. Meanwhile, since the explosive power of the ammunition/explosive is not clear, when the equivalent weight of the ammunition/explosive exceeds the explosion-proof standard of a steel explosion-proof container, secondary damage is easily caused.

When the unexploded ammunition/explosive is destructed, a water cannon is generally used to break down a shell of the ammunition and destruct an internal fuse structure, which may cause explosive fragments of the ammunition to fly, causing injury and death of people. Furthermore, the unexploded ammunition/explosive may have poisonous gas and other harmful factors.

SUMMARY

In view of this, in order to overcome the shortcomings that existing steel explosion-proof equipment has large mass and is prone to secondary damage, protective equipment for destruction of explosives is provided, which can quickly dispose explosives and unexploded military explosives.

The technical solution of the present disclosure: protective equipment for destruction of explosives includes four modules: an inner fence, an outer fence, anti-leakage fence and a top cover. An explosive is a waste military unexploded ammunition or a civilian explosive.

The inner fence and the outer fence are each of a barrel-shaped structure with openings in two ends. The inner fence is in a straight barrel shape; the outer fence includes a conical section and a straight barrel section connected with a small end of the conical section, and the conical section is located below the straight barrel section; the inner fence is coaxially arranged inside the outer fence in a sleeving manner, and a gap is reserved between the inner fence and the outer fence; the top cover covers top openings of the inner fence and the outer fence to close the top openings of the inner fence and the outer fence; the top cover is provided with a through hole running through a space encircled by the inner fence; and the anti-leakage fence is arranged at the periphery of the outer fence.

As a preferable mode of the present disclosure, the height of the anti-leakage fence is ⅓-½ of a height of the outer fence.

As a preferable mode of the present disclosure, the inner fence includes an inner fence bottom supporting plate, an inner fence outer supporting layer, an explosion-proof decontamination liquid layer, an inner fence inner supporting layer, and an inner fence top supporting plate;

the inner fence is of a three-layer structure, including the inner fence outer supporting layer, the explosion-proof decontamination liquid layer, and the inner fence inner supporting layer in sequence from outside to inside; the ringlike inner fence top supporting plate is arranged on a top axial end surface of the inner fence; the ringlike inner fence bottom supporting plate is arranged on a bottom axial end surface of the inner fence; and two or more pores are uniformly formed in an inner circumferential surface of the inner fence inner supporting layer, and a pore area is 30%-70% of a total area of the inner circumferential surface.

As a preferable mode of the present disclosure, the outer fence includes an outer fence bottom supporting plate, an outer fence kinetic energy absorption layer, an outer fence ammunition protection layer, an outer fence outer supporting layer, an outer fence top supporting plate, an outer fence bottom reinforcement layer and a shock wave bottom enhanced ab sorption layer;

the outer fence is of a three-layer structure, including the outer fence kinetic energy absorption layer, the outer fence ammunition protection layer, and the outer fence outer supporting layer in sequence from inside to outside; the ringlike outer fence top supporting plate is arranged on a top axial end surface of the outer fence 1.2; and the ringlike outer fence bottom supporting plate is arranged on a bottom axial end surface of the outer fence;

the outer fence bottom reinforcement layer and the shock wave bottom enhanced absorption layer are arranged at the periphery of the bottom of the outer fence, wherein an inner surface of the shock wave bottom enhanced absorption layer is a circumferential surface, and an outer surface is a conical surface; the outer fence bottom reinforcement layer is located between the shock wave bottom enhanced absorption layer and the outer fence outer supporting layer; and the outer fence bottom reinforcement layer adopts ammunition protection fiber; and the shock wave bottom enhanced absorption layer is a package bag filled with explosion-proof decontamination liquid.

As a preferable mode of the present disclosure, heights of the outer fence bottom reinforcement layer and the shock wave bottom enhanced absorption layer are ¼-½ of the height of the outer fence.

As a preferable mode of the present disclosure, the top cover includes a top cover supporting layer, a top cover explosion-proof decontamination liquid layer and a top ammunition protection layer.

The top cover supporting layer has a cavity inside; the top ammunition protection layer and the top cover explosion-proof decontamination liquid layer are arranged in the cavity in sequence from top to bottom, wherein the top cover explosion-proof decontamination liquid layer is a package bag filled with the explosion-proof decontamination liquid; and a through hole is reserved in the top cover, and runs through the space encircled by the inner fence.

As a preferable mode of the present disclosure, the anti-leakage fence is of a double-layer structure including an inner-layer shock wave absorption layer and an outer-layer ammunition protection plate.

As a preferable mode of the present disclosure, a height of the anti-leakage fence is ⅓-½ of a height of the outer fence.

In addition, the present disclosure provides an explosive destruction system, including protective equipment, a supporting frame and a water cannon. The protective equipment is the above-mentioned protective equipment for explosive destruction.

The supporting frame is used to support and locate the water cannon.

The water cannon is supported and located above the protective equipment through the supporting frame, so that a launching opening of the water cannon extends into the inner fence of the protective equipment from the through hole in the top cover to destruct an explosive in the protective equipment.

In addition, the present disclosure provides an explosive destruction method using the above-mentioned explosive destruction system.

After an explosive is found, the explosive is disposed according to the following mode.

Protection stage: firstly, covering the explosive by the inner fence; then, sleeving an outer part of the inner fence with the outer fence, covering the top cover; placing the anti-leakage fence, assembling the supporting frame, and then, fixing the water cannon on the supporting frame, and making the launching opening of the water cannon extend into the protective equipment to be aligned with a fuse of the explosive; and destruction: remotely controlling the water cannon to launch a high-velocity water flow to destruct the fuse of the explosive; preventing fragments from flying out by the protective equipment if the explosive explodes at the moment; seeing the inside of the protective equipment by an X-ray machine to check the destruction state of the explosive if the fuse of the explosive is destructed, and no explosion occurs; and storing the protective equipment, the supporting frame and the water cannon after the safety is ensured.

Beneficial Effects (1) By a separable (i.e., assembled type in which all modules can be assembled in site during use) structure solution of the protective equipment for explosive destruction, the whole equipment is of a non-metal flexible composite structure. Since a single module is small in mass and convenient to operate, operations can be completed by two persons or one person during use.

During destruction of the explosive, a protective effect can be achieved by means of arranging the protective equipment. No injury will be caused to personnel around even if the ammunition/explosive explodes during the destruction.

(2) The explosive destruction system based on the protective equipment for explosive destruction can destruct the explosive under a protective condition, so as to realize rapid emergency disposal without contacting the explosive.

1—protective equipment; 2—supporting frame; 3—water cannon; 1.1—inner fence; 1.2—outer fence; 1.3—anti-leakage fence; 1.4—top cover; 1.1.1—inner fence bottom supporting plate; 1.1.2—inner fence outer supporting layer; 1.1.3—anti-explosion decontamination liquid layer; 1.1.4—inner fence inner supporting layer; 1.1.5—inner fence top supporting plate; 1.2.1—outer fence bottom supporting plate; 1.2.2—outer fence kinetic energy absorption layer; 1.2.3—outer fence ammunition protection layer; 1.2.4—outer fence outer supporting layer; 1.2.5—outer fence top supporting plate; 1.2.6—outer fence bottom reinforcement layer; 1.2.7—shock wave bottom enhanced absorption layer; 1.3.1—shock wave absorption layer; 1.3.2—ammunition protection plate; 1.4.1—top cover supporting layer; 1.4.2—top cover explosion-proof decontamination liquid layer; 1.4.3—top ammunition protection layer; 1.4.4—top skin; 2.1—fixing base; 2.2—vertical rod; 2.3—supporting rod; 2.5—top sliding rod group; 2.5.1—transverse rod installation screw; 2.5.2—transverse rod; 2.5.3—top rod; 2.5.4—lateral sliding chute rod; and 2.5.5—lateral sliding chute rod fixing screw.

DETAILED DESCRIPTION OF THE EMBODIMENTS

The present disclosure is further described in detail below in combination with accompanying drawings.

Embodiment 1

The present embodiment provides unexploded ammunition/explosive destruction protective equipment which uses a modularized assembled type structure, and can quickly dispose an explosive and unexploded military ammunition without causing secondary damage.

Figure 1:
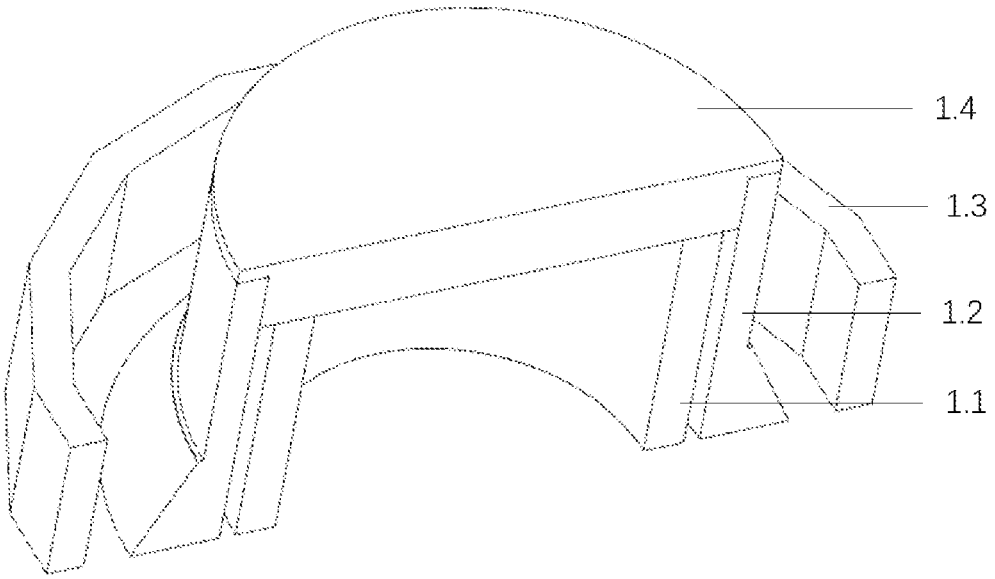
FIG. 1 is a schematic structural diagram of protective equipment of the present disclosure.

As shown in FIG. 1, the unexploded ammunition/explosive destruction protective equipment includes four modules: an inner fence 1.1, an outer fence 1.2, an anti-leakage fence 1.3, and a top cover 1.4. The inner fence 1.1 and the outer fence 1.2 are each of a barrel-shaped structure with openings in two ends. The inner fence 1.1 is a straight barrel (with an equal diameter); the outer fence 1.2 includes a conical section and a straight barrel section connected with a small end of the conical section; the conical section is located below the straight barrel section; the inner fence 1.1 is coaxially arranged inside the outer fence 1.2 in a sleeving manner, and a gap is reserved between the inner fence 1.1 and the outer fence 1.2; the top cover 1.4 covers top openings of the inner fence 1.1 and the outer fence 1.2 to close the top openings of the inner fence 1.1 and the outer fence 1.2; the top cover 1.4 is provided with a through hole running through a space encircled by the inner fence 1.1; and a circle of anti-leakage fence 1.3 is arranged at the periphery of the outer fence 1.2.

Figure 2:
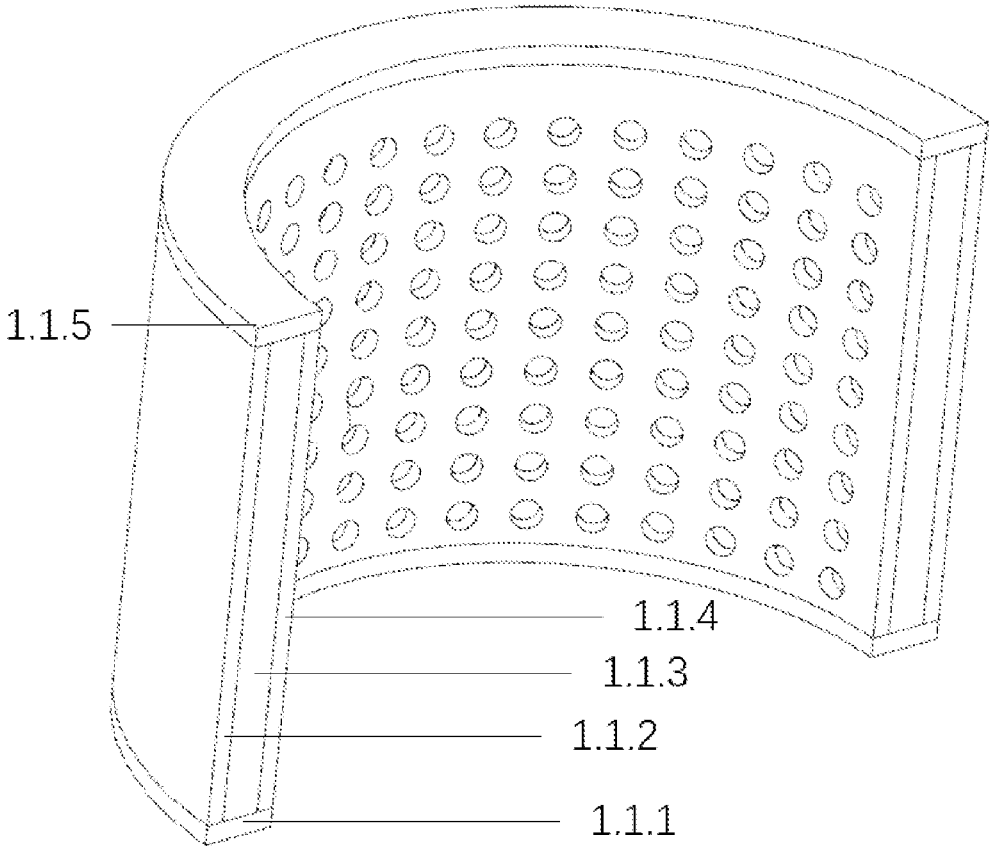
FIG. 2 is a schematic structural diagram of an inner fence of the protective equipment.

As shown in FIG. 2, the inner fence 1.1 includes an inner fence bottom supporting plate 1.1.1, an inner fence outer supporting layer 1.1.2, an explosion-proof decontamination liquid layer 1.1.3, an inner fence inner supporting layer 1.1.4, and an inner fence top supporting plate 1.1.5. The inner fence 1.1 is of a three-layer structure, including the inner fence outer supporting layer 1.1.2, the explosion-proof decontamination liquid layer 1.1.3, and the inner fence inner supporting layer 1.1.4 in sequence from outside to inside. The ringlike inner fence top supporting plate 1.1.5 is arranged on a top axial end surface; and the ringlike inner fence bottom supporting plate 1.1.1 is arranged on a bottom axial end surface. That is, the inner fence outer supporting layer 1.1.2, the inner fence inner supporting layer 1.1.4, the inner fence bottom supporting plate 1.1.1, and the inner fence top supporting plate 1.1.5 encircle to form a barrel-shaped structure with an inner ringlike cavity (a ringlike cavity between the inner fence outer supporting layer 1.1.2 and the inner fence inner supporting layer 1.1.4). A package bag filled with explosion-proof decontamination liquid is installed in the ringlike cavity to form the explosion-proof decontamination liquid layer 1.1.3. Two axial ends of the inner fence outer supporting layer 1.1.2 and the inner fence inner supporting layer 1.1.4 are respectively adhered to the inner fence top supporting plate 1.1.5 and the inner fence bottom supporting plate 1.1.1 through epoxy resin glue.

The inner fence bottom supporting plate 1.1.1, the inner fence outer supporting layer 1.1.2, the inner fence inner supporting layer 1.1.4, and the inner fence top supporting plate 1.1.5 use polyurea sprayed with foam or other viscous-elastic materials; a plurality of pores are uniformly distributed in an inner circumferential surface of the inner fence inner supporting layer 1.1.4, and a pore area is 30%-70% of a total area of the inner circumferential surface to enable shock waves and liquid in the explosion-proof decontamination liquid layer 1.1.3 to be fully mixed, which is more favorable for reduction of the shock waves. The inner fence 1.1 is mainly structurally supported by the inner fence bottom supporting plate 1.1.1, the inner fence outer supporting layer 1.1.2 and the inner fence inner supporting layer 1.1.4. Constituents of the explosion-proof decontamination liquid include a liquid decontamination agent and water-absorbing resin. The type of the liquid decontamination agent can be added according to possible toxins of unexploded ammunition. For example, 2% hypochlorite, peroxyacetic acid, sodium carbonate and water (a mass fraction is 1:12.5) are added, and the package bag filled with the explosion-proof decontamination liquid is made of a material that does not react with the explosion-proof decontamination liquid, such as a polytetrafluoroethylene package tape.

Figure 3:
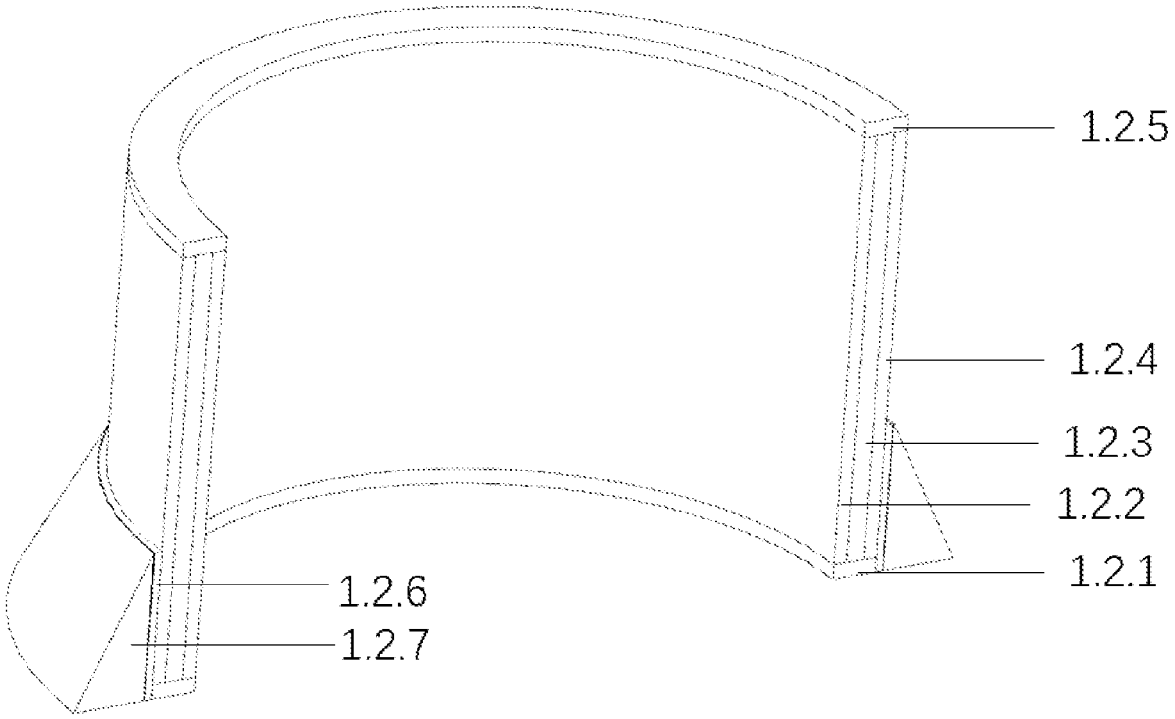
FIG. 3 is a schematic structural diagram of an outer fence of the protective equipment.

As shown in FIG. 3, the outer fence 1.2 includes an outer fence bottom supporting plate 1.2.1, an outer fence kinetic energy absorption layer 1.2.2, an outer fence ammunition protection layer 1.2.3, an outer fence outer supporting layer 1.2.4, an outer fence top supporting plate 1.2.5, an outer fence bottom reinforcement layer 1.2.6 and a shock wave bottom enhanced absorption layer 1.2.7. The outer fence 1.2 is of a three-layer structure, including the outer fence kinetic energy absorption layer 1.2.2, the outer fence ammunition protection layer 1.2.3, and the outer fence outer supporting layer 1.2.4 in sequence from inside to outside; the ringlike outer fence top supporting plate 1.2.5 is arranged on a top axial end surface; and the ringlike outer fence bottom supporting plate 1.2.1 is arranged on a bottom axial end surface. The outer fence bottom supporting plate 1.2.1, the outer fence outer supporting layer 1.2.4 and the outer fence top supporting plate 1.2.5 are all supported by foam, and outer surfaces thereof are sprayed with polyurea or other viscous-elastic materials to achieve a supporting function; the adjacent outer fence kinetic energy absorption layer 1.2.2, the outer fence ammunition protection layer 1.2.3 and the outer fence outer supporting layer 1.2.4 are adhered to each other through epoxy resin glue; and two axial ends of the outer fence kinetic energy absorption layer 1.2.2, the outer fence ammunition protection layer 1.2.3 and the outer fence outer supporting layer 1.2.4 are respectively adhered to the outer fence top supporting plate 1.2.5 and the outer fence bottom supporting plate 1.2.1 through epoxy resin glue.

The outer fence kinetic energy absorption layer 1.2.2 realizes kinetic energy absorption and supporting by mainly using a polyurea sprayed PC plate; the outer fence ammunition protection layer 1.2.3 mainly plays an ammunition protection role, and is made of one of, or hybrid ammunition protection fiber selected from two or more of PE, aramid fiber, glass fiber, carbon fiber, or PBO fiber.

The outer fence bottom reinforcement layer 1.2.6 and the shock wave bottom enhanced absorption layer 1.2.7 are arranged at the periphery of the bottom of the outer fence 1.2. Heights of the outer fence bottom reinforcement layer 1.2.6 and the shock wave bottom enhanced absorption layer 1.2.7 are about ¼-½ of the whole height of the outer fence 1.2. An inner surface of the shock wave bottom enhanced absorption layer 1.2.7 is a circumferential surface, and an outer surface is a conical surface. The outer fence bottom reinforcement layer 1.2.6 is located between the shock wave bottom enhanced absorption layer 1.2.7 and the outer fence outer supporting layer 1.2.4. The outer fence bottom reinforcement layer 1.2.6 uses ammunition protection fiber with a thickness of 10 mm-20 mm, so that loading from post-explosion products on the fragments can be effectively prevented; the shock wave bottom enhanced absorption layer 1.2.7 is a package bag filled with the explosion-proof decontamination liquid, and includes the same constituents as the constituents of the explosion-proof decontamination liquid layer 1.1.3 in the inner fence 1.1; and a bottom shock wave pressure peak value can be effectively reduced by means of the shock wave bottom enhanced absorption layer 1.2.7.

Figure 4:
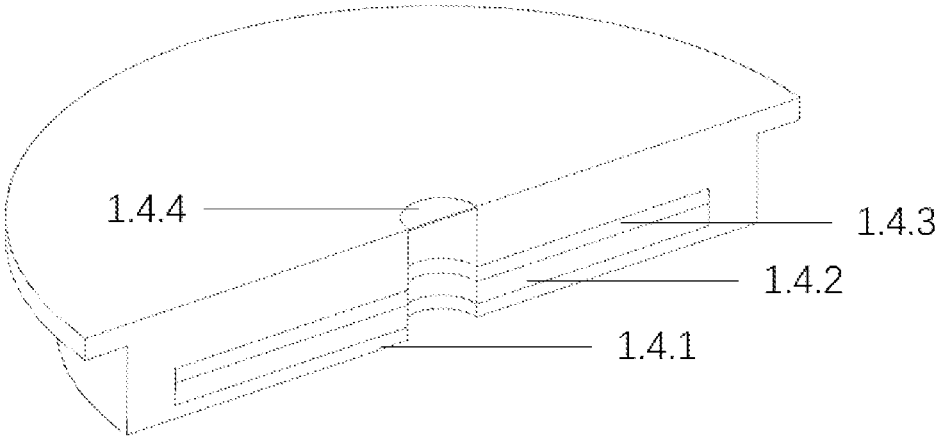
FIG. 4 is a schematic structural diagram of a top cover of the protective equipment.

As shown in FIG. 4, the top cover 1.4 includes a top cover supporting layer 1.4.1, a top cover explosion-proof decontamination liquid layer 1.4.2 and a top ammunition protection layer 1.4.3; the top cover supporting layer 1.4.1 has a cavity inside; the top ammunition protection layer 1.4.3 and the top cover explosion-proof decontamination liquid layer 1.4.2 are arranged in the cavity in sequence from top to bottom, wherein the top cover explosion-proof decontamination liquid layer 1.4.2 is a package bag filled with explosion-proof decontamination liquid having the same constituents as the explosion-proof decontamination liquid layer 1.1.3 in the inner fence 1.1; the top ammunition protection layer 1.4.3 uses one of, or hybrid ammunition protection fiber selected from two or more of PE, aramid fiber, glass fiber, carbon fiber, or PBO fiber; the top cover supporting layer 1.4.1 is formed by spraying polyurea to polyurethane foam; and the top cover supporting layer 1.4.1 is packaged by oxford fabric. The through hole is reserved in the top cover 1.4, so that the water cannon launches a water flow to destruct the ammunition. That is, the through hole runs through the space encircled by the inner fence 1.1. In order to ensure the appearance of the structure, the through hole in the top of the top cover 1.4 is covered by a top skin 1.4.4; and a material of the top skin 1.4.4 is low-intensity cloth.

Figure 5:
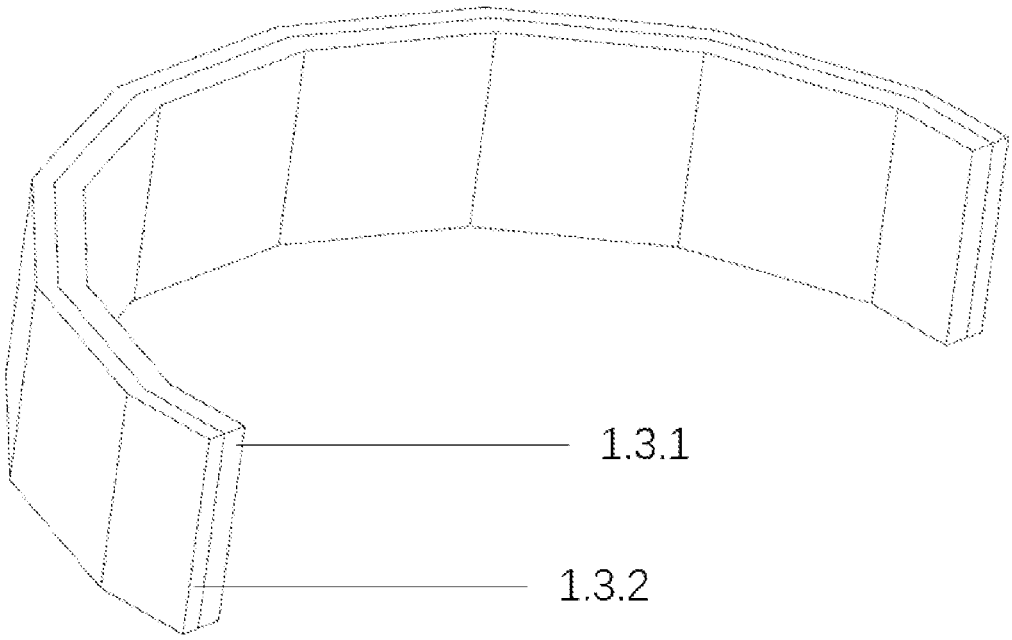
FIG. 5 is a schematic structural diagram of an anti-leakage fence of the protective equipment.

As shown in FIG. 5, the anti-leakage fence 1.3 is mainly used to prevent leakage of the fragments to play a protection enhanced role. The anti-leakage fence 1.3 is of a double-layer structure, including an inner-layer shock wave absorption layer 1.3.1 and an outer-layer ammunition protection plate 1.3.2. The inner-layer shock wave absorption layer 1.3.1 is used to absorb shock waves and uses polyurethane foam. Preferably, a density of the polyurethane foam is 50 $kg/m^3$-200 $kg/m^3$; the ammunition protection plate 1.3.2 uses a hard PE plate or an aramid plate; and the anti-leakage fence 1.3 has a height that is ⅓-½ of the height of the outer fence 1.2, and is foldable. During pressing of the PE plate or the aramid plate, bent parts are not pressed, so that the flexibility of the structure can be maintained, and convenient folding is achieved.

Embodiment 2

Figure 6:
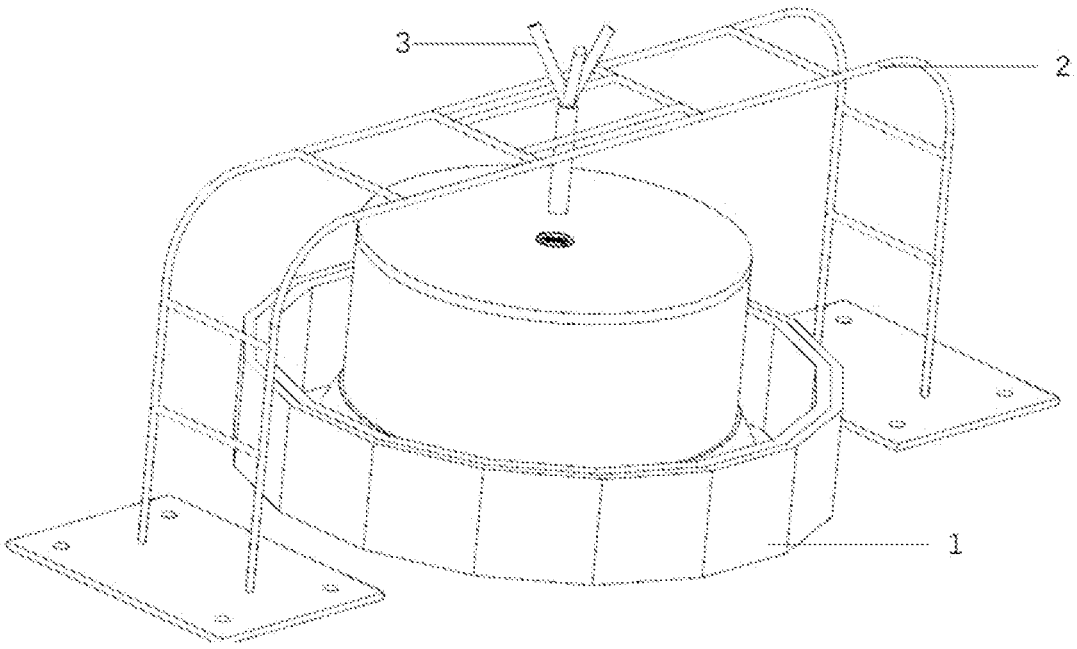
FIG. 6 is a schematic structural diagram of a protective system using the protective equipment of the present disclosure.

The embodiment provides an unexploded ammunition/explosive destruction system. As shown in FIG. 6, the unexploded ammunition/explosive destruction system includes the protective equipment 1 in the above-mentioned embodiment 1, a supporting frame 2 and a water cannon 3. The type of the water cannon 3 is commercially available.

The supporting frame 2 uses a hollow steel pipe used to support and locate the water cannon 3; the water cannon 3 is supported and located above the protective equipment 1 through the supporting frame 2, so that a launching opening of the water cannon 3 extends into the inner fence 1.1 of the protective equipment 1 from the through hole in the top cover 1.4 to destruct an unexploded ammunition/explosive placed in the protective equipment 1 through the water cannon.

Since the protective equipment 1 is separable, i.e., since the protective equipment 1 is of a modularized assembled structure, during destruction of the unexploded ammunition/explosive, the protective equipment 1 can be assembled directly in site without moving to the position of the unexploded ammunition/explosive, and the unexploded ammunition/explosive is placed inside the inner fence 1.1 of the protective equipment 1; then, the water cannon 3 is supported and located through the supporting frame 2; the launching opening of the water cannon 3 can extend from the through hole in the top cover 1.4 into the inner fence 1.1 of the protective equipment 1; and the water cannon 3 is started to destruct the unexploded ammunition/explosive in the protective equipment 1.

Figure 7:
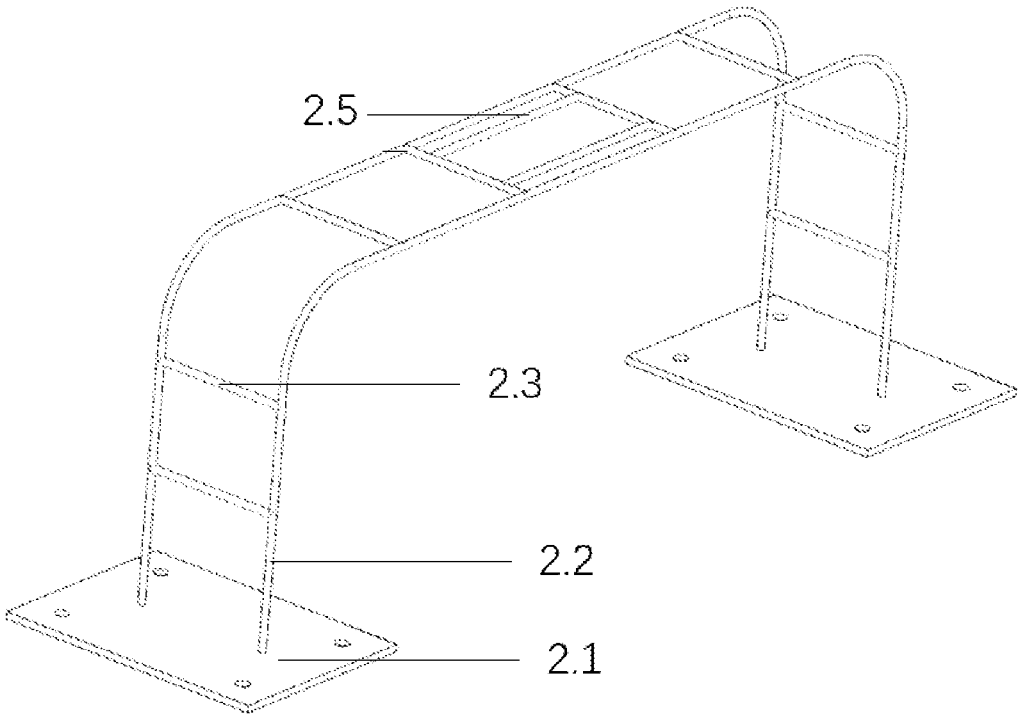
FIG. 7 is a schematic structural diagram of a supporting frame of the protective system.

As shown in FIG. 7, the supporting frame 2 is of an inverted U-shaped structure, and includes fixing bases 2.1, vertical rods 2.2, supporting rods 2.3, and a top sliding rod group 2.5; two fixing bases 2.1 are respectively arranged on two sides of an opened end of the inverted U-shaped structure; the supporting frame 2 is fixed on the ground through the fixing bases 2.1; left and right ends of the top sliding rod group 2.5 are supported on the fixing bases 2.1 on the corresponding sides through two groups of parallel arc-shaped rods and two groups of parallel vertical rods 2.2; and two supporting rods 2.3 are arranged between the two parallel vertical rods 2.2 on the same side.

Figure 8:
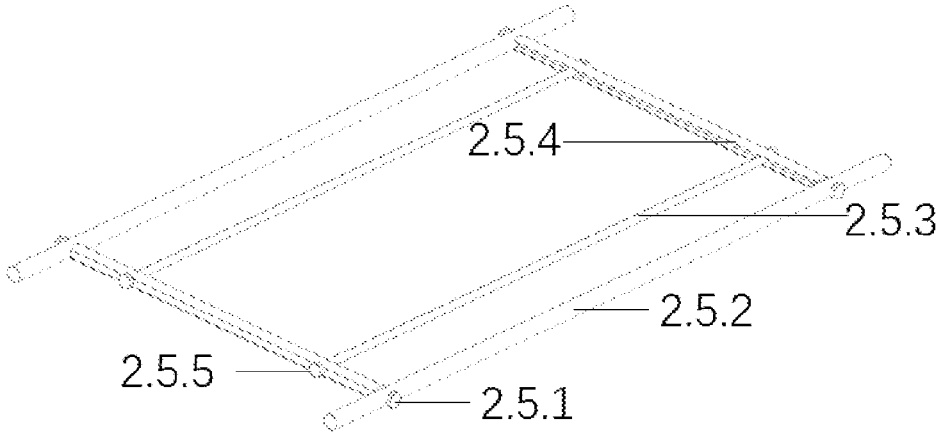
FIG. 8 is an enlarged diagram of a top of the supporting frame.

As shown in FIG. 8, the top sliding rod group 2.5 is of a rectangular structure, and includes two parallel transverse rods 2.5.2 and two parallel lateral sliding chute rods 2.5.4; the two transverse rods 2.5.2 and the two lateral sliding chute rods 2.5.4 are connected to form a rectangular structure; the lateral sliding chute rods 2.5.4 are provided with sliding chutes in length directions of the the lateral sliding chute rods 2.5.4; two parallel top rods 2.5.3 are mounted between the two lateral sliding chute rods 2.5.4; the two top rods 2.5.3 slide in the sliding chutes of the lateral sliding chute rods 2.5.4 to adjust a distance between the two top rods 2.5.3 (to adapt to water cannons 3 of different types and facilitate the installation of the water cannons 3); and after the desired distance is achieved through adjustment, the top rods 2.5.3 are fastened on the lateral sliding chute rods 2.5.4 through lateral sliding chute rod fixing screws 2.5.5.

A use process of the unexploded ammunition/explosive destruction system is as follows.

After an unexploded ammunition is found, the unexploded ammunition is disposed according to the following mode.

Protection stage:

1, the inner fence 1.1 is first lifted to cover the unexploded ammunition; 2, the outer fence 1.2 is lifted to sleeve the inner fence 1.1;

3, the top cover 1.4 is covered; and 4, the anti-leakage fence 1.3 is placed.

Assembly of the supporting frame 2:

1, the vertical rods 2.2 are fixed on the fixing bases 2.1 through screws, and meanwhile, the supporting rods 2.3 are mounted on the vertical rods 2.2 through screws;

2, the top sliding rod group 2.5 is mounted on the vertical rods 2.2 through screws, and the position of the top sliding rod group 2.5 is adjusted in place;

3, the supporting frame 2 is lifted to the unexploded ammunition;

4, the fixing bases 2.1 are fixed on the ground through ground anchors, or a sand bag is lifted to press the fixing bases 2.1;

5, the water cannon 3 is firmly fixed on the supporting frame 2 by twisting iron wires; and 6, the launching opening of the water cannon 3 is aligned with the fuse of the unexploded ammunition.

Destruction:

1, the water cannon 3 is remotely controlled to launch a high-velocity water flow to destruct the fuse of the unexploded ammunition;

2, if the unexploded ammunition explodes at the moment, the protective equipment 1 can prevent fragments from flying out, prevent shock waves from damaging the surroundings and avoid injury of persons or property;

3, if the fuse of the unexploded ammunition is destructed at the moment, and the unexploded ammunition does not explode, the inside is seen by an X-ray machine to check the destruction state; and after the safety is ensured, the equipment can be stored for next use.

Although the present disclosure has been described in detail above with general descriptions and specific embodiments, it is obvious for those skilled in the art to make some modifications or improvements on the basis of the present disclosure. Therefore, these modifications or improvements made without departing from the spirit of the present disclosure all fall within the protection scope of the present disclosure.

What is claimed is:

1. A protective equipment for destruction of explosives, comprising four modules:

an inner fence (1.1), an outer fence (1.2), anti-leakage fence (1.3) and a top cover (1.4); an explosive being a waste military unexploded ammunition or civilian explosive;

wherein the inner fence (1.1) and the outer fence (1.2) are each of a barrel-shaped structure with openings in two ends, wherein the inner fence (1.1) is in a straight barrel shape, the outer fence (1.2) comprises a conical section and a straight barrel section connected with a small end of the conical section, and the conical section is located below the straight barrel section; the inner fence (1.1) is coaxially arranged inside the outer fence (1.2) in a sleeving manner, and a gap is reserved between the inner fence (1.1) and the outer fence (1.2); the top cover (1.4) covers top openings of the inner fence (1.1) and the outer fence (1.2) to close the top openings of the inner fence (1.1) and the outer fence (1.2); the top cover (1.4) is provided with a through hole running through a space encircled by the inner fence (1.1); the anti-leakage fence (1.3) is arranged at the periphery of the outer fence (1.2);

the outer fence (1.2) comprises: an outer fence bottom supporting plate (1.2.1), an outer fence kinetic energy absorption layer (1.2.2), an outer fence ammunition protection layer (1.2.3), an outer fence outer supporting layer (1.2.4), an outer fence top supporting plate (1.2.5), an outer fence bottom reinforcement layer (1.2.6) and a shock wave bottom enhanced absorption layer (1.2.7);

the outer fence (1.2) is of a three-layer structure, comprising the outer fence kinetic energy absorption layer (1.2.2), the outer fence ammunition protection layer (1.2.3), and the outer fence outer supporting layer (1.2.4) in sequence from inside to outside; the ringlike outer fence top supporting plate (1.2.5) is arranged on a top axial end surface of the outer fence (1.2); the ringlike outer fence bottom supporting plate (1.2.1) is arranged on a bottom axial end surface of the outer fence (1.2);

the outer fence bottom reinforcement layer (1.2.6) and the shock wave bottom enhanced absorption layer (1.2.7) are arranged at the periphery of the bottom of the outer fence (1.2); an inner surface of the shock wave bottom enhanced absorption layer (1.2.7) is a circumferential surface, and an outer surface is a conical surface; the outer fence bottom reinforcement layer (1.2.6) is located between the shock wave bottom enhanced absorption layer (1.2.7) and the outer fence outer supporting layer (1.2.4); and the outer fence bottom reinforcement layer (1.2.6) uses ammunition protection fiber, and the shock wave bottom enhanced absorption layer (1.2.7) is a package bag filled with explosion-proof decontamination liquid.

2. The protective equipment according to claim 1, wherein a height of the anti-leakage fence (1.3) is ⅓-½ of a height of the outer fence (1.2).

3. The protective equipment according to claim 1, wherein the inner fence (1.1) comprises: an inner fence bottom supporting plate (1.1.1), an inner fence outer supporting layer (1.1.2), an explosion-proof decontamination liquid layer (1.1.3), an inner fence inner supporting layer (1.1.4), and an inner fence top supporting plate (1.1.5);

the inner fence (1.1) is of a three-layer structure, including the inner fence outer supporting layer (1.1.2), the explosion-proof decontamination liquid layer (1.1.3), and the inner fence inner supporting layer (1.1.4) in sequence from outside to inside; the ringlike inner fence top supporting plate (1.1.5) is arranged on a top axial end surface of the inner fence (1.1); the ringlike inner fence bottom supporting plate (1.1.1) is arranged on a bottom axial end surface of the inner fence (1.1); and two or more pores are uniformly formed in an inner circumferential surface of the inner fence inner supporting layer (1.1.4), and a pore area is 30%-70% of a total area of the inner circumferential surface.

4. The protective equipment according to claim 1, wherein heights of the outer fence bottom reinforcement layer (1.2.6) and the shock wave bottom enhanced absorption layer (1.2.7) are ¼-½ of the height of the outer fence (1.2).

5. The protective equipment according to claim 1, wherein the top cover (1.4) comprises: a top cover supporting layer (1.4.1), a top cover explosion-proof decontamination liquid layer (1.4.2) and a top ammunition protection layer (1.4.3); and the top cover supporting layer (1.4.1) has a cavity inside, and the top ammunition protection layer (1.4.3) and the top cover explosion-proof decontamination liquid layer (1.4.2) are arranged in the cavity in sequence from top to bottom, wherein the top cover explosion-proof decontamination liquid layer (1.4.2) is a package bag filled with explosion-proof decontamination liquid.

6. The protective equipment according to claim 1, wherein the anti-leakage fence (1.3) is of a double-layer structure, comprising an inner-layer shock wave absorption layer (1.3.1) and an outer-layer ammunition protection plate (1.3.2).

7. The protective equipment according to claim 5, wherein a height of the anti-leakage fence (1.3) is ⅓-½ of the height of the outer fence (1.2).

8. An explosive destruction system, comprising a protective equipment (1) according to claim 1, a supporting frame (2) and a water cannon (3);

wherein the supporting frame (2) is used to support and locate the water cannon (3);

the water cannon (3) is supported and located above the protective equipment (1) through the supporting frame (2), so that a launching opening of the water cannon (3) extends into an inner fence (1.1) of the protective equipment (1) from a through hole in a top cover (1.4) to destruct an explosive in the protective equipment (1).

9. An explosive destruction method for disposing an explosive, using the explosive destruction system according to claim 8, the method comprising:

protection stage: covering the explosive by an inner fence (1.1); sleeving the outside of the inner fence (1.1) with an outer fence (1.2); covering a top cover (1.4); placing an anti-leakage fence (1.3);

assembling a supporting frame (2);

fixing a water cannon (3) on the supporting frame (2), and making an launching opening of the water cannon (3) extend into protective equipment (1) to enable the launching opening to be aligned with a fuse of the explosive; and destruction: remotely controlling the water cannon (3) to launch a high-velocity water flow to destruct the fuse of the explosive; preventing fragments from flying out by the protective equipment (1) in the case that the explosive explodes at the moment, seeing the inside of the protective equipment (1) by an X-ray machine to check the destruction state of the explosive in the case that the fuse of the explosive is destructed and no explosion occurs, and storing the protective equipment (1), the supporting frame (2) and the water cannon (3) after the safety is ensured.

* * * * *